United States Patent [19]

Lynch et al.

[11] Patent Number: 4,995,604

[45] Date of Patent: Feb. 26, 1991

[54] AEROBIC WATER WEIGHT

[76] Inventors: Ronald E. Lynch; Bradley W. Smith, both of 3601-24th Ave. W. #201, Seattle, Wash. 98199

[21] Appl. No.: 301,651

[22] Filed: Jan. 25, 1989

[51] Int. Cl.[5] ..... A63B 21/072

[52] U.S. Cl. ..... 272/122; 272/71; 272/143; 434/254

[58] Field of Search ..... 272/71, 117, 93, 143, 272/96, 122; 441/60; 434/254

[56] References Cited

U.S. PATENT DOCUMENTS

| | | | |
|---|---|---|---|
| 4,211,402 | 7/1980 | Carroll | 272/93 |
| 4,362,518 | 12/1982 | Boissiere | 441/60 |
| 4,384,714 | 5/1983 | Kimura | 272/119 |
| 4,513,961 | 4/1985 | Killen | 272/119 |
| 4,690,399 | 9/1987 | Hayashi | 272/122 X |
| 4,700,369 | 10/1987 | Siegal et al. | 377/24.2 |
| 4,773,640 | 9/1988 | Kolbel et al. | 272/122 |

FOREIGN PATENT DOCUMENTS

| | | | |
|---|---|---|---|
| 3211825 | 10/1983 | Fed. Rep. of Germany | 272/122 |

OTHER PUBLICATIONS

"Polyurethane"; Henri Ulrich, *Modern Plastics Encyclopedia* 1985-1986, pp. 78, 80, 82, 476, 487-488.

German publication dated 12-1983-"Ellipsen-Hantel-für Mannerfauste Mabgeschneidert", pp. 7, 76, 77, 96, 104, 105.

*Primary Examiner*—Richard J. Apley
*Assistant Examiner*—D. F. Crosby
*Attorney, Agent, or Firm*—Patrick Michael Dwyer

[57] ABSTRACT

An aerobic water exercise weight 10 having opposed handles 11 and curbed leg gripping surfaces 14, with weight pocket(s) 13 and weight(s) 15 insertable therein.

10 Claims, 1 Drawing Sheet

AEROBIC WATER WEIGHT

TECHNICAL FIELD

The invention relates to the field of exercise equipment and particularly to weight training equipment. More particularly, the invention relates to a training weight for aerobic water exercise.

BACKGROUND OF THE INVENTION

Aerobic exercise can often be more beneficially performed in water, as the nature of water exercise helps prevent stress injuries to the skeletal structure of the body and overexertion of muscle tissues, thus preventing tissue tears and hyperextensions. Free weights are commonly employed in studio dance-type aerobic exercise, but no known free weight is readily adaptable for an aerobic water exercise program employing weight training principles.

DISCLOSURE OF THE INVENTION

Accordingly it is an object of the invention to provide a free water weight for aerobic water exercise.

It is a further object of the invention to provide a water weight suitable for both upper and lower body workouts.

It is a further object of the invention to provide a water weight whose negative buoyancy can be varied to accommodate a range of conditioned persons from novice to athlete.

It is yet another object of the invention to provide a water weight contoured for ease of holding the weight between the legs during exercise.

These and other objects of the invention to be disclosed in this specification are accomplished by the method and apparatus herein described.

The apparatus of the invention comprises a contoured apparatus with handles which in use is held by the water exerciser in relatively shallow water to create in the exerciser a slight negative buoyancy necessitating vigorous treading of water with the feet. This provides a lower body workout. The apparatus may also be held between the thighs of the exerciser and the exercise is performed with the arms for an upper body workout. The method of the invention comprises the steps of standing in water no deeper than chin height; placing between the thighs a contoured weight of such mass and displacement that the combination of the weight and the body of the exerciser assume a negative buoyancy; and treading water using the muscles of the upper torso and arms to keep the exerciser's mouth and nose above the surface of the water.

Alternatively the method of the invention may comprise the steps of standing in water no deeper than chin height; holding in one or both hands a contoured weight of such mass and displacement that the combination of the weight and the body of the exerciser assume a negative buoyancy; and treading water using just the lower body muscles to keep the exerciser's mouth and nose above the surface of the water.

The invention provides a new and completely different way to work out. It is used in shallow water for a low impact aerobic exercise that works on every major muscle group to both burn fat and build white and red muscle tissue for size as well as definition. Based on principles of treading water, the apparatus of the invention acts to effectively decrease the buoyancy of the exerciser's body thus increasing the amount of energy that the athlete needs to expend in order to stay afloat. The unbuoyed weight of the apparatus may range anywhere from a few ounces to 20 pounds in order to accommodate novices as well as conditioned athletes Exercise of this sort also improves circulation, builds endurance and provides an excellent cardio-vascular workout. In a preferred embodiment the apparatus will be available in weight ranges between 2–15 pounds.

The apparatus of the invention may be made of rubber, metal, polyurethane or any other suitable product which may be die stamped or molded, particularly by an injection molding process. It may also contain pockets of gas to alter buoyancy rates or may be adapted for the insertion of additional metal weights to further alter buoyancy. Preferably handles will be inlaid with a softer sheet of foam rubber or other suitable sponge-like material for a more comfortable hand grip.

In a preferred embodiment a fundamentally rectilinearly shaped weight is employed with handles at either of the long ends for ease of use in holding the weight above the head of the exerciser. The top and bottom surfaces of the weight are preferably curved inward toward each other to accommodate the gripping action of holding the weight between the thighs or calves of the exerciser. Additionally, in a preferred embodiment tubular voids may be cast into the weight for the insertion therein of supplemental relatively denser weight material to further increase the negative buoyancy effects of the apparatus.

BEST MODE FOR CARRYING OUT THE INVENTION

Figure 1:
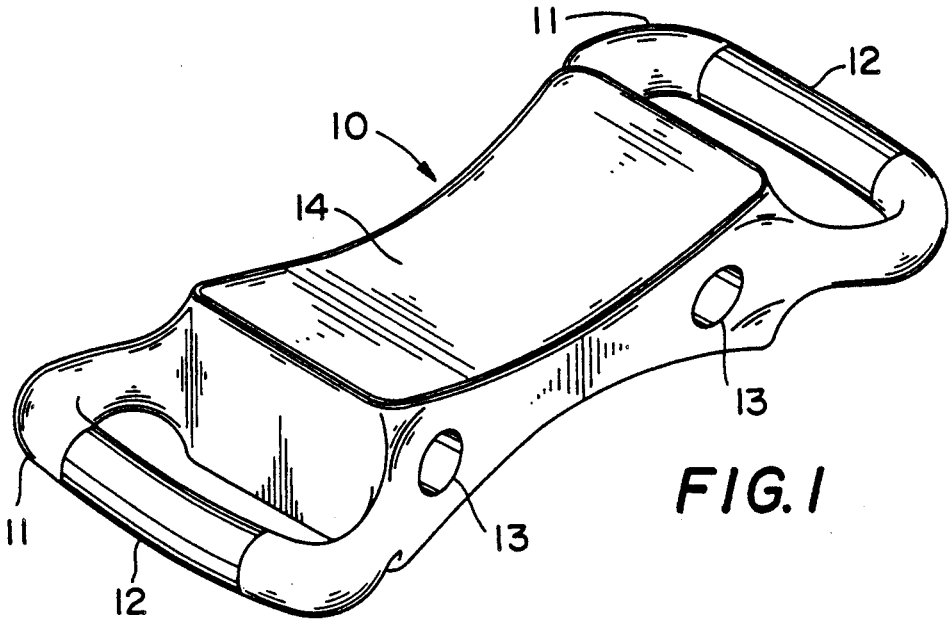
FIG. 1 is an isometric view of the apparatus of the invention.
Figure 2:
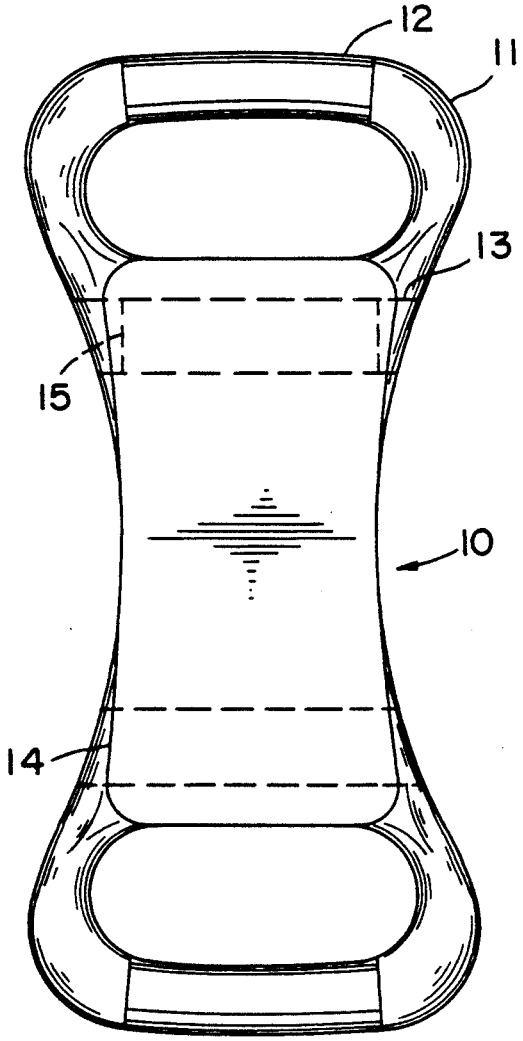
FIG. 2 is a plan view of the apparatus of the invention.
Figure 3:
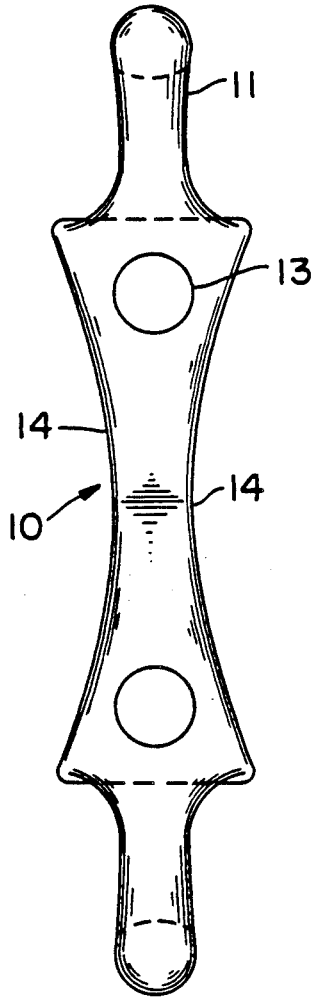
FIG. 3 is a side view of the apparatus of the invention.

Referring now to drawings wherein like numbers indicate like parts a preferred embodiment of the invention is described. A water weight 10 is generally disclosed throughout the figures. Water weight 10 is a generally rectilinear shape with inwardly curved leg grip surfaces 14 and opposed handles 11 each having thereon a hand grip 12. Water weight 10 preferably has one or more pockets 13 for the insertion therein of supplemental weights 15. Preferably pockets 13 pass completely through water weight 10, but other embodiments may contain pockets which do not pass completely through the water weight or no pockets at all. Furthermore other embodiments are contemplated having less than two handles, and handles which are not placed at opposing ends of the water weight. Also water weights are contemplated which do not employ inwardly curved surfaces but rather some other means of accommodating gripping of the apparatus between the legs of the exerciser.

The apparatus of the invention is made by the injection molding process and is made of polyurethane. However other materials may be employed in other processes to arrive at equivalent structures, such as by dye stamping, machining, or open mold pouring. It has been found that a clear amber castable polyurethane mold compound PMC-719, with product no. 99520(black pigment in dioctyl phthalate,) added for color, both purchased from Smooth-On Inc., 1000 Valley Road, Gillette, N.J. 09933, are well adapted for manufacturing the apparatus of the invention.

Virtually any substance having a density greater than water may be employed which can be poured, molded, or machined. In fact substances having a density less than that of water may be employed in embodiments having weight pockets into which can be added sufficiently dense weight material to give the apparatus an overall negative buoyancy.

The apparatus is employed by standing in water which is preferably not over the head of the exerciser, and further preferably no deeper than chin level, and holding the apparatus at approximately eye level. The exerciser then begins to tread water using just the lower body by employing a whip or scissor kick in the recommended form of exercise. The overall negative buoyancy of the combined exerciser and water weight will cause the exerciser to tend to sink in the water, which tendency must be counteracted by the expenditure of exercising force from the water treading kicks This exercise is continued for 30–60 seconds interspersed with approximately 30 second rest periods. At the end of the lower body exercise period signaled by muscular exhaustion, the apparatus is placed between the legs, preferably between the thighs, and water treading is resumed, this time using only the upper body. This exercise is continued in the same manner as recommended for the lower body. Periods of exercise longer than 30–60 seconds may be employed as conditioning improves, the longer the better. Upper and lower body workouts are alternated until maximum muscle exhaustion occurs. This should take the novice about 20 minutes and the more advanced athlete 30–40 minutes. It is expected that the exerciser will repeat this regimen 3 to 4 times a week or every other day. As endurance improves and the exerciser can maintain a workout for 40 minutes or more an apparatus of greater weight, i.e. greater negative buoyancy, is employed to increased the exercise resistance. Alternatively an apparatus containing weight pockets can be employed wherein heavier and heavier weights are inserted into the pockets in order to increase the exercise resistance. Advanced athletes may also prefer to exercise in somewhat deeper water than discussed above.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

This invention will find use in the exercise and body development industry where a low cost, durable, reusable water weight is required as weight resistance to aerobic water exercise. The invention can be effectively and inexpensively manufactured for wide use by exercisers in this industry.

We claim:

1. A water weight for aerobic water exercise having a generally rectilinear shape, said weight comprising at least one handle, a pair of opposed inwardly curving leg grip surfaces, and one or more externally accessible weight pockets extending substantially across said rectilinear shape for receiving supplemental weights to adjust the buoyancy of said water weight.

2. The apparatus of claim 1 wherein, with said pockets empty of supplemental weight, said water weight has a negative buoyancy.

3. The apparatus of claim 2 wherein said water weight is comprised of solid polyurethane.

4. The apparatus of claim 2 wherein a variable negative buoyancy for said water weight is achieved, in combination with one or more supplemental weights, by inserting one or more of said supplemental weights into one or more of said pockets.

5. The apparatus of claim 4 wherein said water weight is comprised of solid polyurethane.

6. The apparatus of claim 2 wherein said negative buoyancy may be varied from a few ounces to twenty pounds.

7. The apparatus of claim 6 wherein said negative buoyancy may be varied between 2–15 pounds.

8. The apparatus of claim 1 having two of said handles and wherein said handles are opposed to one another across said water weight.

9. The apparatus of claim 1 in combination with a supplemental weight disposed in each of one or more of said weight pockets.

10. The apparatus of claim 1 wherein, with said pockets empty of supplemental weight, said water weight has a positive buoyancy.

* * * * *